United States Patent [19]

Taylor

[11] 3,935,760

[45] Feb. 3, 1976

[54] TOOL FOR REMOVING SHOCK ABSORBERS AND THE LIKE

[76] Inventor: Bobby W. Taylor, Rte. 1, Cache, Okla. 73527

[22] Filed: Jan. 31, 1974

[21] Appl. No.: 438,224

[52] U.S. Cl. ..... 81/55
[51] Int. Cl.[2] ..... B25B 13/06
[58] Field of Search ..... 81/55

[56] References Cited

UNITED STATES PATENTS

| | | | |
|---|---|---|---|
| 956,467 | 4/1910 | Anderson | 81/55 |
| 2,736,220 | 2/1956 | Kamuk | 81/55 |
| 2,772,590 | 12/1956 | Werries | 81/55 |
| 2,790,343 | 4/1957 | White | 81/55 |

FOREIGN PATENTS OR APPLICATIONS

| | | | |
|---|---|---|---|
| 447,901 | 4/1948 | Canada | 81/55 |
| 876,655 | 5/1953 | Germany | 81/55 |

*Primary Examiner*—James L. Jones, Jr.
*Attorney, Agent, or Firm*—Dunlap, Codding & McCarthy

[57] ABSTRACT

The present invention includes an improved tool particularly useful for effecting the removal of a shock absorber from the upper structural member of an automobile frame, having a base member and an insert member slidably disposed within an opening through one end of the base member. One end of the base member is retainingly disposed over the nut securing the threaded extension of a shock absorber to the upper structural member and the end of the insert member disposed within the base member opening is retainingly connected to a head portion of the threaded extension, the base member being held in a stationary position thereby securing the nut in a stationary position while the insert member is rotated thereby rotating the shock absorber via the head portion connected thereto. The tool of the present invention thus allows the shock absorber to be rotated to unthread the connection between the shock absorber and the nut which secures the shock absorber to the automobile upper structural member.

7 Claims, 5 Drawing Figures

TOOL FOR REMOVING SHOCK ABSORBERS AND THE LIKE

BACKGROUND OF THE INVENTION

1. Field of the Invention

The present invention relates generally to a tool for effecting the removal of a threaded member from a nut and, more particularly, but not by way of limitation, to an improved tool for effecting the removal of a threaded member portion of a shock absorber from a nut which secures the upper end of the shock absorber to an upper structural member of an automobile frame.

2. Brief Description of the Prior Art

In the past, various tools generally referred to as wrenches or other tools generally referred to as combination type tools have been constructed for connecting elements to threaded fastener members or disconnecting the elements therefrom. One such tool was disclosed in the U.S. Pat. No. 2,453,901, issued to Gonsett, which included a socket head portion insertable over a nut type of fastener and a screw-driver like element disposed within the tool, the combination tool being constructed for utilization as a socket-head type of wrench or a screw-driver. Another such combination wrench and screw-driver was disclosed in the U.S. Pat. No. 2,464,058, issued to Rogers.

The U.S. Pat. No. 2,601,796, disclosed a tool having one portion insertable over a nut type of fastener and having an opening receiving a screw-driver so a threaded member could be removed from the nut by turning the threaded member via the screw-driver. The U.S. Pat. No. 3,452,373, issued to Vosbikian, also disclosed a combination screw-driver and socket wrench wherein the screw-driver element was disposed within an opening forming the socket head portion of the tool. Another combination tool was disclosed in the U.S. Pat. No. 3,508,455, issued to Miller.

SUMMARY OF THE INVENTION

An object of the invention is to provide an improved tool for removing threaded members from nut like fasteners in a more convenient manner.

One other object of the invention is to provide an improved tool for disconnecting the upper end portion of a shock absorber from an upper structural member of an automobile frame in a faster, more convenient and more economical manner.

A further object of the invention is to provide an improved tool for removing threaded members from nut like fasteners which are located in remote locations in a faster, more convenient manner.

A yet further object of the invention is to provide an improved tool for disconnecting the upper end portion of a shock absorber from an upper structural member of an automobile frame which is more economical in the construction and the operation thereof.

Other objects and advantages of the invention will be evident via the following detailed description when read in conjunction with the drawings which illustrate one preferred embodiment of the invention.

BRIEF DESCRIPTION OF THE DRAWINGS

FIG. 2 is a sectional view of the tool of FIG. 1, but showing the insert member disposed within the base member opening, the tool being positioned to disconnect the upper end of a shock absorber (partially shown) from the upper structural member (partially shown) of an automobile frame or the like.

DESCRIPTION OF THE PREFERRED EMBODIMENTS

Figure 1:
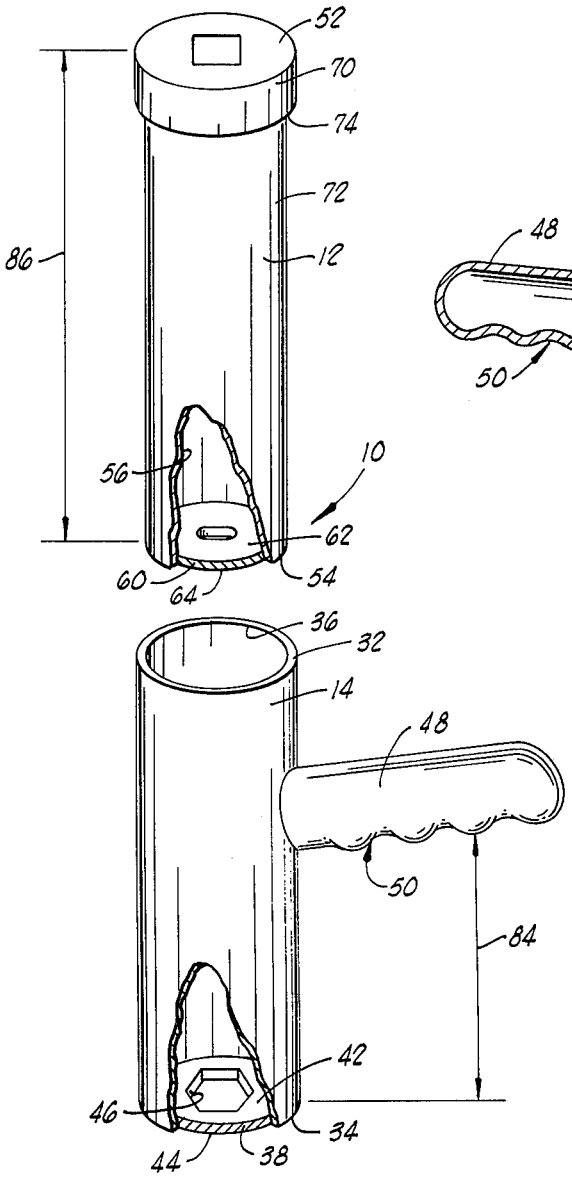
FIG. 1 is a partial perspective view of the tool of the present invention showing the insert member disposed above the base member.
Figure 2:
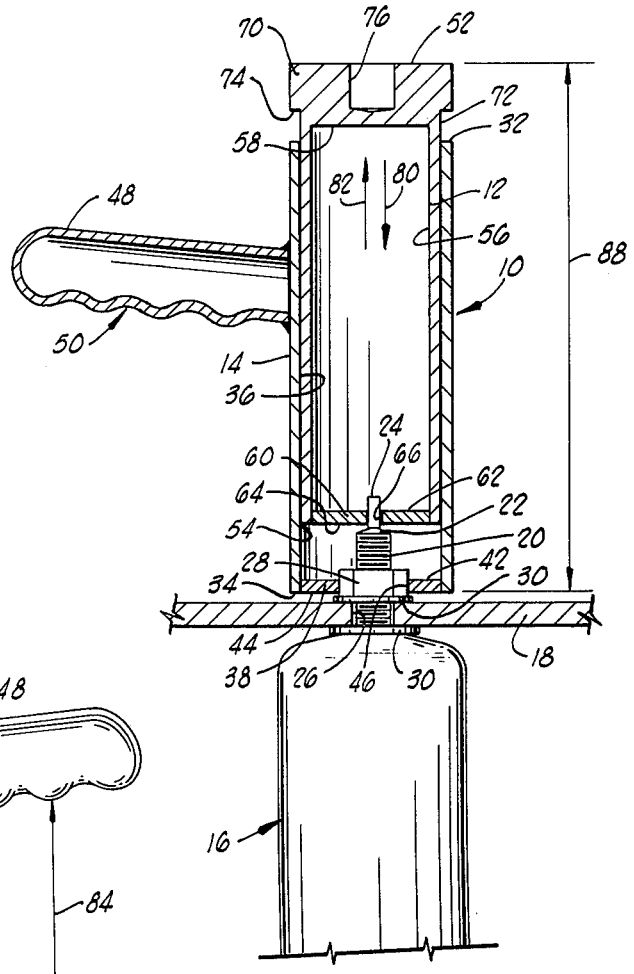

Referring to the drawings in general and to FIGS. 1 and 2 in particular, shown therein and designated via the general reference numeral 10, is a tool constructed in accordance with the present invention. The tool 10 basically includes a base member 14 and an insert member 12, and is particularly useful for removing the shock absorbers connected between an extension of an automobile frame supporting the front wheels and an upper structural member which is secured to the automobile frame.

In some automobile constructions for example, the upper end of the shock absorber (an upper end portion of a typical shock absorber being shown in FIG. 2 and designated via the general reference 16) is connected to an upper structural member (partially shown in FIG. 2 and designated via the general reference 18) and the lower end of the shock absorber 16 is connected to an extension of the automobile frame or, more particularly, an extension generally referred, to as an "A" frame in some automobile constructions. In any event, the term "extension of the automobile frame" generally refers to the structural members connecting the automobile frame to the wheels for supporting pivotal movement and the term "upper structural member," including the upper structural member 18, generally refers to the structural member connected to the automobile frame and positioned to provide a structural member for connecting the upper end of the shock absorber 16 to the automobile frame.

A threaded extension 20 is formed on the upper end of the shock absorber 16 and extends a distance therefrom terminating with an outermost end 22. A solid, generally rectangularly shaped head 24 is formed on the outermost end 22 of the threaded extension 20 and extends a distance therefrom, as shown in FIG. 2, the head 24 having a smaller length and a smaller width as compared to the outer diameter of the threaded extension 20.

In an assembled position of the shock absorber 16, the lower end of the shock absorber 16 is secured to the extension of the automobile frame supporting one of the automobile wheels (not shown) and the threaded extension is disposed through an opening 26 in the upper structural member 18. A nut 28 is threadedly secured to the portion of the threaded extension 20 extending above the upper structural member 18, a portion of the nut 28 engaging the upper structural member 18 thereby securing the upper end of the shock absorber 16 to the upper structural member 18. As shown in FIG. 2, washers 30 are disposed between the nut 28 and the upper structural member 18 and between the shock absorber 16 and the upper structural member 18, the washers 30 being disposed about threaded extension 20. It might also be noted that rubber gromets (not shown) are also disposed about the threaded extension 20 near the washers 30 in some assembled applications, for example.

To remove or disassemble the shock absorber 16 from the upper structural member 18, it is generally necessary to secure some type of wrench over the nut 28, and break the connection between the nut 28 and the threaded extension 20. In many instances, this task has posed several time consuming problems such as the nut 28 being extremely difficult to break loose because of rust or corrosion or the like or the location of the nut 28 being such that it is extremely difficult to conveniently reach with ordinary wrenches or other such tools for unthreading the nut 28, for example. In any event, the problem of removing the nut 28 or, more particularly, removing the connection between the upper end of the shock absorber 16 and the automobile upper structural number 18 has been time and effort consuming, the tool 10 being constructed to effect this removal in a relatively short time, in a manner requiring less effort and the tool 10 being constructed to be attachable to the nut 28 and upper end of the shock absorber 16 in a more convenient manner as will become more apparent below.

Figure 3:
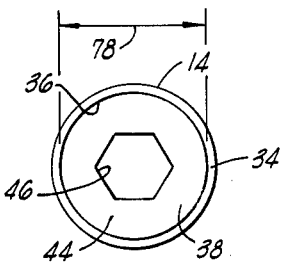
FIG. 3 is a lower end elevational view of the base member of FIGS. 1 and 2.

The base member 14 is generally cylindrically shaped having an upper end 32, a lower end 34 and an opening 46 extending axially therethrough intersecting the upper and the lower ends 32 and 34. A circularly shaped plate 38, having an upper surface 44 and a lower surface 42, is disposed in the opening 36 generally adjacent the lower end 34 and secured to the base member 14, the plate 38 substantially enclosing the opening 36 at the lower end 34 and forming what is sometimes referred to herein as the closed lower end 34 of the base member 14. As shown in FIGS. 1 and 2, the lower surface 42 of the plate 38 is substantially coplanar with the lower end 34 of the base member 14 in the assembled position of the plate 38 secured to the base member 14. As shown more clearly in FIG. 3, a hexagonal shaped nut opening 46 is formed through a central portion of the plate 38 and the nut opening 46 is sized to retainingly and engagingly receive the nut 28, a portion of the nut 28 being disposed through the nut opening 46 and portions of the plate 38 formed via the nut opening 46 engagingly retaining the nut 28 during the operation of the tool 10, as will be described below.

One end of a handle 48, having a hand gripping surface 50 formed on a portion thereof, is secured to a portion of the outer peripheral surface of the base member 14. The handle 48 extends a distance from the base member 14 and, in one preferred form, the handle 48 extends at a slight angle from the base member 14 so the hand gripping surface 50 may be grippingly engaged via an individual for holding the base member 14 in a substantially stationary position during the operation of the tool 10.

Figure 4:
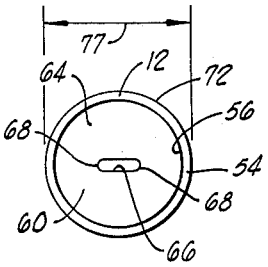
FIG. 4 is a lower end elevational view of the insert member of FIGS. 1 and 2.

The insert member 12 is generally cylindrically shaped having an upper end 52, a lower end 54 and an opening 56 extending a distance axially therethrough intersecting the lower end 54 thereof terminating with an end wall 58. A circularly shaped plate 60, having an upper surface 62 and a lower surface 64, is disposed in the opening 56 generally adjacent the lower end 54 and is secured to the insert member 12, the plate 60 substantially enclosing the lower end 54 and the lower surface 64 being disposed in a substantially coplanar disposition with the lower end 54 in an assembled position of the plate 60 and the insert member 12. A generally rectangularly shaped opening 66 is formed through the plate 60, the opening 66 having rounded end portions 68, as shown more clearly in FIG. 4. The opening 66 is shaped to receive a portion of the head 24 formed on the outermost end of the threaded extension 20 and portions of the plate 60 formed via the opening 66 retainingly engage adjacent portions of the head 24 disposed therethrough during the operation of the tool 10 as will be described in greater detail below.

Since the plate 38 is secured to the base member 14, the plate 38 is sometimes referred to herein as the lower end of the base member 14, the opening 36 extending a distance through the base member 14 terminating with the upper surface 44 of the plate 38. By the same token, since the plate 60 is secured to the insert member 12, the plate 60 is sometimes referred to herein as the lower end of the insert member 12.

Figure 5:
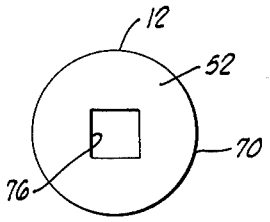
FIG. 5 is an upper end elevational view of the insert member of FIGS. 1, 2 and 4.

A flange 70 is formed on an outer peripheral surface 72 of the insert member 12, generally adjacent the upper end 52, the flange 70 extending a distance radially from the surface 72 forming a downwardly facing surface 74 extending annularly about the insert member 12 and spaced a distance from the upper end 52. A square shaped wrench recess 76 is formed in a central portion of the upper end 52 extending a distance axially downwardly toward the end wall 58, as shown more clearly in FIGS. 2 and 5. The wrench recess 76 is shaped to receive a manual or pneumatically operated turning tool (not shown) for rotating the insert member 12 during the operation of the tool 10.

The diameter 77 of the insert member 12 formed via the outer peripheral surface 72 is less than the diameter 78 formed in the base member 14 via the opening 36. The diameters 77 and 78 are sized such that the lower end 54 of the insert member 14 is telescopingly insertable through the opening 36 via the upper end 32 of the base member 14 and a portion of the insert member 12 is slidingly disposed in the opening 36 of the base member 14 in an operative, assembled position of the insert member 12 and the base member 14. The insert member 12 is slidable in a downward direction 80 and in an upward direction 82 within the opening 36 of the base member 14, the downwardly facing surface 74 engaging the upper end 32 limiting the sliding movement of the insert member 12 in a downward direction 80 thereby positioning the insert member 12 in the opening 36 so the insert member 12 can be removed therefrom by gripping the flange 70 and pulling the insert member 12 in the upward direction 82.

During the operation of the tool 10, the lower end 54 of the insert member 12 is inserted through the opening 36 via the upper end 32 of the base member 14, and the insert member 12 is allowed to slide in a downward direction 80 to a position wherein the downwardly facing surface 74 engages the upper end 32. In this position, the lower end 54 and the lower surface 64 are each spaced a distance above upper surface 44, the length of the insert member 12 between the downwardly facing surface 74 and the lower end 54 being less than the length of the base member 14 between the upper end 32 and the upper surface 44 to effect the spacing in one preferred form.

After the insert member 12 has been slidably disposed in the opening 36 of the base member 36, the operator grips the handle 48 and positions the tool 10 generally above the nut 28 and the portion of the threaded extension 20. The tool 10 is maneuvered to a position wherein the portion of the threaded extension 20 extending above the nut 28 is disposed through the nut opening 46 extending a distance through opening 36 above the upper surface 44 of the plate 38. Further, the tool 10 and, more particularly, the base member 14, is maneuvered to a position wherein the nut 28 is disposed through the nut opening 46 and the nut 28 is retainingly engaged via portions of the plate 38 formed via the nut opening 46. In this position the nut 28 is removably and yet retainingly secured to the base member 14.

The insert member 12 is then rotated within the opening 36 of the base member 14 to a position wherein the opening 66 is aligned with the head 24 formed on the outermost end 22 of the threaded extension 20. In this position, the insert member 12 is slidingly moved through the opening 36 in a downward direction 80, inserting the head 24 through the opening 66 to a position wherein the lower surface 64 engages the outermost end 22 of the threaded extension 22 limiting the further movement of the insert member 12 in the downward direction 80. In this position, the head 24 is retainingly engaged via portions of the plate 60 formed via the opening 66 and thus the head 24 is removably yet retainingly secured to the insert member 12.

After the nut 28 has been disposed through the nut opening 46 of the base member 14 and after the head 24 has been disposed through the opening 66 of the insert member 12, the operator grips the handle 48 and holds the base member 14 in a substantially stationary position thereby preventing the rotation of the nut 28 via the retaining engagement between the nut 28 and the base member 14. A break-over tool or other such wrench is then inserted into the wrench recess 76 and the wrench like tool (not shown) is then rotated turning or rotating the insert member 12 within the opening 36 of the base member 14 thereby rotating the head 24 via the retaining engagement between the head 24 and the insert member 12. Since the head 24 is secured to the shock absorber 16 or, in one sense, an integral part of the shock absorber 16, the shock absorber 16 is rotated via the rotation of the head 24.

It should be noted that the connection between the lower end of the shock absorber 16 (not shown) and extension of the automobile frame (not shown) is removed or disconnected prior to the disconnection of the upper end of the shock absorber 16 and the upper structural member 18 utilizing the tool 10 of the present invention. Thus, the rotation of the head 24 via the rotating of the insert member 12 causes the shock absorber 16 to be rotated. To effect the removal of the shock absorber 16, the insert member 12 is rotated in a direction such that the threaded extension 20 is unthreaded from the nut 28. Utilizing the tool 10, the shock absorber 16 is thus actually spun or rotated out of the nut 28, since the nut 28 is secured in a stationary position via the base member 14.

As mentioned before, the connection between the upper structural member 18 and the shock absorber 16 or, in other words, the disposition of the nut 28 is many times disposed such that it is extremely difficult, if not impossible, to directly attach a pneumatic or hand-powered break-over tool or other such wrench like tool to the nut 28. The distance 84 between the handle 48 and the lower end 34 of the base member 14 is such that the handle 48 is spaced a sufficient distance 84 above the connection between the upper structural member 18 and the shock absorber 16 so that the operator can easily and conveniently grip the handle 48 during the positioning of the lower end 34, over the nut 28 and during the removal of the shock absorber 16 via the tool 10. Further, the distance 86 between the upper end 52 and the lower end 54 of the insert member 12, and the distance 88 between the upper end 52 of the insert member 12 and the lower end 34 of the base member 14 is such that the upper end 52 of the insert member 12 is spaced a sufficient distance above the connection between the upper structural member 18 and the shock absorber 16 so that the operator can easily, conveniently and quickly connect a wrench like tool to the insert member 12 via the wrench recess 76 for rotating the insert member 12 during the removal of the shock absorber 16 via the tool 10, in a manner described before.

The tool 10 is thus quickly and easily connected to the nut 28 and the shock absorber 16 and provides a fast, convenient tool for removing shock absorbers particularly adapted to effect the removal of the shock absorber from the upper structural member 18. The two-piece construction (the insert member 12 and the base member 14) results in a tool which can be quickly and easily assembled and which can be disassembled and stored in a quick and convenient manner.

Changes may be made in the various elements and assemblies and in the operation of the tool as described herein without departing from the spirit and the scope of the invention as defined via the following claims.

I claim:

1. A tool for removing a threaded member from a nut fastener or the like, comprising:

a base member, having an upper end, a lower end and an opening extending a distance therethrough intersecting the upper end and the lower end thereof;

a plate connected to the lower end portion of the base member substantially encompassing the base member opening generally near the lower end of the base member, a nut opening being formed through the plate and intersecting the base member opening for removably and retainingly receiving the nut fastener or the like;

a handle connected to the base member and spaced a distance from the lower end of the base member; and an insert member, having an upper end, a lower end and an outer peripheral surface, the nut opening in the base member being smaller than the diameter formed via the outer peripheral surface of the insert member and the insert member being slidably insertable within the base member opening only via the intersection of the base member opening with the upper end of the base member, an opening formed through the lower end of the insert member for removably and retainingly receiving a portion of the threaded member, the nut opening being shaped and sized independent of the shape and size of the opening in the lower end of the insert member and independent of the size and shape of the insert member, and the insert member being rotatable within the base member opening for rotating the portion of the threaded member disposed through the opening in the insert member lower end, the rotation of the insert member unthreadingly removing the threaded member from the nut fastener or the like while substantially maintaining the base member and the nut fastener or the like retainingly received thereby in a relatively stationary position.

2. The apparatus of claim 1 wherein the insert member includes an opening extending a distance therethrough intersecting the lower end thereof, and wherein the insert member is defined further to include:

a plate secured to the lower end portion of the insert member substantially encompassing the insert member opening generally near the lower end of the insert member, the opening for receiving a portion of the threaded member being formed through a portion of the plate.

3. The apparatus of claim 1 wherein the insert member includes a flange formed on the outer peripheral surface thereof extending a distance therefrom and forming a downwardly facing surface engageable with the upper end of the base member limiting the sliding movement of the insert member in the base member opening in one direction.

4. The apparatus of claim 1 wherein the insert member includes a wrench recess formed in the upper end thereof for receiving a portion of a turning tool or the like for rotating the insert member.

5. The apparatus of claim 1 wherein the length of the insert member, generally between the upper and the lower ends thereof, and the length of the base member, generally between the upper and the lower ends thereof, are each of a sufficient size to space the upper end of the insert member a predetermined distance above the lower end of the base member in a retainingly engaged position of the nut fastener or the like and the base member and in a retainingly engaged position of the threaded member and the insert member, the upper end of the insert member being remotely disposed with respect to the nut fastener or the like and the threaded member and the upper end of the insert member being engageable via a turning tool or the like for rotating the insert member.

6. The apparatus of claim 1 wherein the insert member is cylindrically shaped.

7. The apparatus of claim 1 wherein the tool removes a threaded member connected to a shock absorber from threaded engagement with a nut fastener securing the shock absorber to an upper structural member of an automobile frame, the lower end of the base member substantially maintaining the nut fastener in a relatively stationary position while turning the insert member for rotating the threaded member.

* * * * *